US010690357B1

(12) United States Patent
Orndorff et al.

(10) Patent No.: US 10,690,357 B1
(45) Date of Patent: Jun. 23, 2020

(54) AIR-COOLED CONDENSER HAIL PROTECTION SYSTEM

(71) Applicants: Owen Orndorff, Boise, ID (US); R. Lee Roberts, Boise, ID (US); Jeffrey L. Smith, Boise, ID (US)

(72) Inventors: Owen Orndorff, Boise, ID (US); R. Lee Roberts, Boise, ID (US); Jeffrey L. Smith, Boise, ID (US)

(73) Assignee: HAIL PROTECTION, INC, Boise, ID (US)

( * ) Notice: Subject to any disclaimer, the term of this patent is extended or adjusted under 35 U.S.C. 154(b) by 0 days.

(21) Appl. No.: 15/530,891

(22) Filed: Mar. 16, 2017

(51) Int. Cl.

| | |
|---|---|
| ***C03B 5/16*** | (2006.01) |
| ***C03B 5/18*** | (2006.01) |
| ***C03B 5/225*** | (2006.01) |
| ***F24F 1/58*** | (2011.01) |
| ***F24F 1/14*** | (2011.01) |

(52) U.S. Cl.
CPC . *F24F 1/58* (2013.01); *F24F 1/14* (2013.01)

(58) Field of Classification Search
CPC ..... F24F 1/58; F24F 13/20; F24F 1/14
USPC ..... 65/134.1
See application file for complete search history.

(56) References Cited

U.S. PATENT DOCUMENTS

| | | | | |
|---|---|---|---|---|
| 4,475,585 | A * | 10/1984 | Hoeffken | F24F 13/20 165/122 |
| 5,341,860 | A * | 8/1994 | Klein | F24F 13/20 150/165 |
| 2013/0040554 | A1* | 2/2013 | Hartmann | F24F 1/58 454/367 |
| 2013/0291440 | A1* | 11/2013 | Herlihy | F24F 13/20 49/463 |
| 2017/0074526 | A1* | 3/2017 | Colantuoni | F24F 1/50 |

* cited by examiner

*Primary Examiner* — Davis D Hwu
(74) *Attorney, Agent, or Firm* — Patrick J. Walsh

(57) ABSTRACT

A system for protecting air cooled condensers from hailstone damage including system components and method of installation, in which a protective screen preferably of stainless steel mesh is draped over and supported above condenser components to degrade hailstone momentum by reducing both velocity and mass, and by exposing residual hail to heat energy of air exhausting from the condenser.

5 Claims, 3 Drawing Sheets

AIR-COOLED CONDENSER HAIL PROTECTION SYSTEM

FIELD OF THE INVENTION

The present invention relates to air-cooled condensers, particularly to a system for protecting air-cooled condensers from hailstone damage.

BACKGROUND OF THE INVENTION

Air-cooled condensers are used with steam turbine power plants to directly condense exhaust steam flow from the steam turbine and return condensate to the power plant boiler without water loss. An air-cooled condenser unit typically comprises an A-frame or delta arrangement of exhaust steam duct distributing steam to finned tubes and down through the tubes that condense the exhaust steam. Air fans at the base of the A-frame deliver cooling air upward over the finned tubes to ambience. Condensate is drained effectively in such condensers and returned to the boiler without loss.

These condenser units are used in electrical power plants and other energy plants of all sizes, and are normally arranged in multiple rows within a surrounding wind wall.

The air-cooled condensers including exhaust steam distribution ducts and finned tubes are located outdoors open upwardly to the atmosphere, and are susceptible to hail storm damage. The size of a hailstone and its velocity determine the amount of damage caused by impact on condenser exhaust steam distribution ducts and finned tubes. The momentum of a hailstone can be calculated as equaling the mass of the stone times its velocity. If the value of either or both of these values can be reduced, the momentum of a hailstone will be less when it hits a heat transfer surface and thus less energy will be imparted to the condenser.

Finned tubes in an air cooled condenser are a point of transfer of exhaust steam heat to ambient cooling air. Hailstone damage to finned tubes can significantly reduce their heat transfer capability, and power plant capacity. Fin damage is detrimental mainly because once crushed, air flow is blocked rendering those sections of heat transfer surface basically useless. In a severe hailstorm where fins are crushed overall plant power generating capacity can be reduced by as much as 25%. Damage to the fins is permanent and the value of the power plant is degraded. At an approximate value of $2000 per KW, loss of power plant capacity is costly in degraded plant value.

The present invention provides a system to protect heat transfer surfaces of air-cooled condensers from damaging thermodynamic and economic effects of hailstone impact.

SUMMARY OF THE INVENTION

The present invention provides an air cooled condenser hail protection system for decaying the momentum of hailstones threatening exposed condenser components. The system effectively decays hailstone momentum by reducing both mass and velocity, and by exposing decayed hailstones to heat energy contained in cooling air flowing through condenser finned tubes to atmosphere.

The system safeguards condenser finned tubes from thermodynamic damage, and the power plant from loss of generating capacity and economic degradation.

The protective action is provided by draping a mesh screen over the tops of the steam distribution ducts and anchoring the ends to the wind walls on each side of the condenser. The mesh runs the full length of the air-cooled condenser. The mesh screen slows the velocity of hail and breaks up larger hailstones to minimize damage to tube fins. The system is not intended to stop or collect the hail, but some buildup of hail on the mesh is accounted for and melted fairly quickly by exhaust cooling air. Air flowing out of the condenser through the mesh has a temperature as high as 150° F. This helps reduce the amount of collected hail and any collected hail melts quickly due to good heat transfer characteristics of the mesh. The mesh itself conducts heat well and retains its integrity in high exhaust cooling air temperatures.

The preferred screen material is 304 stainless steel wire mesh with one-inch square openings and an open area of approximately 78%.

The mesh is draped over structural supports above exhaust steam duct's to prevent damage of mesh rubbing duct, as well as hail damage to the duct. The tension load in the mesh is taken up at outside screen walls by anchoring the mesh to structural members between screen wall columns.

The mesh does not decrease exhaust cooling air flow significantly, however, there is a slight increase in pressure necessary to move the air. But the screen has a tendency to make the airflow more uniform across the unit.

Polyethylene mesh material have been considered and found less desirable than metallic mesh for several reasons. High exhaust air temperatures and continuous solar UV exposure make polyethylene mesh suspect for durability and strength over time. Polyethylene being flexible would tend to catch and collect hail rather that break it up and slow its velocity. Hail collection in protective mesh could quickly overload existing air cooled condenser support structure and wind walls. Polyethylene is a non-conductor of heat and would result in slower melt of collected hail.

Fiberglass grating was also considered, however cost and weight and installation requirements result in the grating being more difficult to provide the same level of protection as mesh materials.

Stainless steel mesh is approximately one-half the cost of polyethylene material, has superior durability, although the weight is approximately ten times greater than polyethylene.

So, various materials are considered for their advantages and stainless steel mesh is preferred for a hail protection system for air cooled condensers.

Specific examples of the invention are included in the following description for purposes of clarity, but various details can be changed within the scope of the present invention.

OBJECTS OF THE INVENTION

An object of the invention is to provide a system for protecting air cooled condensers from hailstone damage.

Another object of the invention is to provide system for decaying the momentum of hailstones threatening air cooled condenser components.

Another object of the invention is to protect air cooled condensers from thermodynamic and economic damage brought on by hailstorms.

Another object of the invention is to provide a hailstone protective system for air cooled condensers which decays hailstone momentum by reducing both mass and velocity, and by exposing decayed hailstones to heat energy of cooling air emerging from the condenser.

Another object of the invention is to provide a hailstone protective system for air cooled condensers comprising a metallic mesh deployed over a condenser that decays hailstone momentum by reducing both mass and velocity.

Other and further objects of the invention will become apparent with an understanding of the following detailed description of the invention or upon employment of the invention.

BRIEF DESCRIPTION OF THE DRAWING

Preferred embodiment of the invention have been chosen for detailed description to enable those having ordinary skill in the art to which the invention appertains to readily understand how to construct and use the invention and is shown in the accompanying drawing in which.

DETAILED DESCRIPTION OF PREFERRED EMBODIMENT

Figure 1:
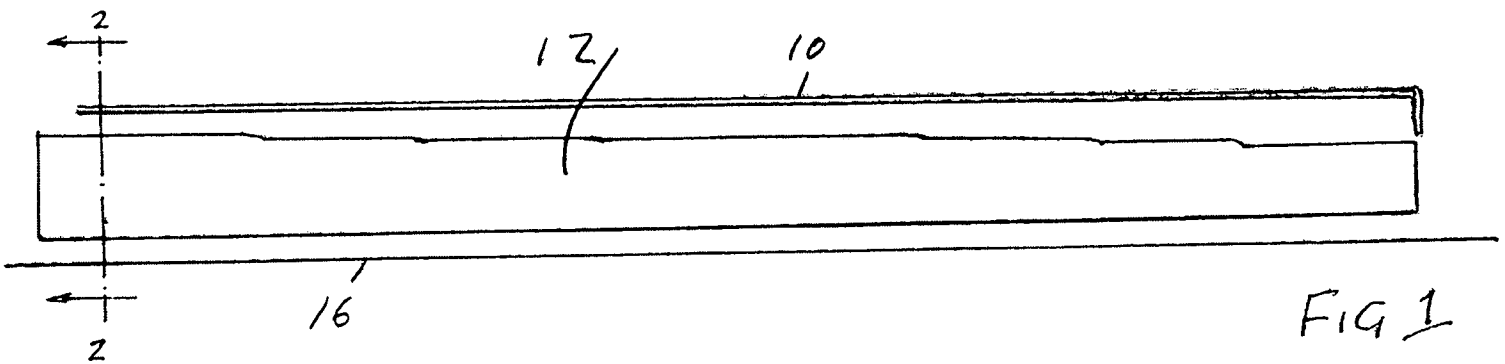
FIG. 1 is an elevation view showing air-cooled condenser steam distribution duct, wind wall, and protective screen.
Figure 2:
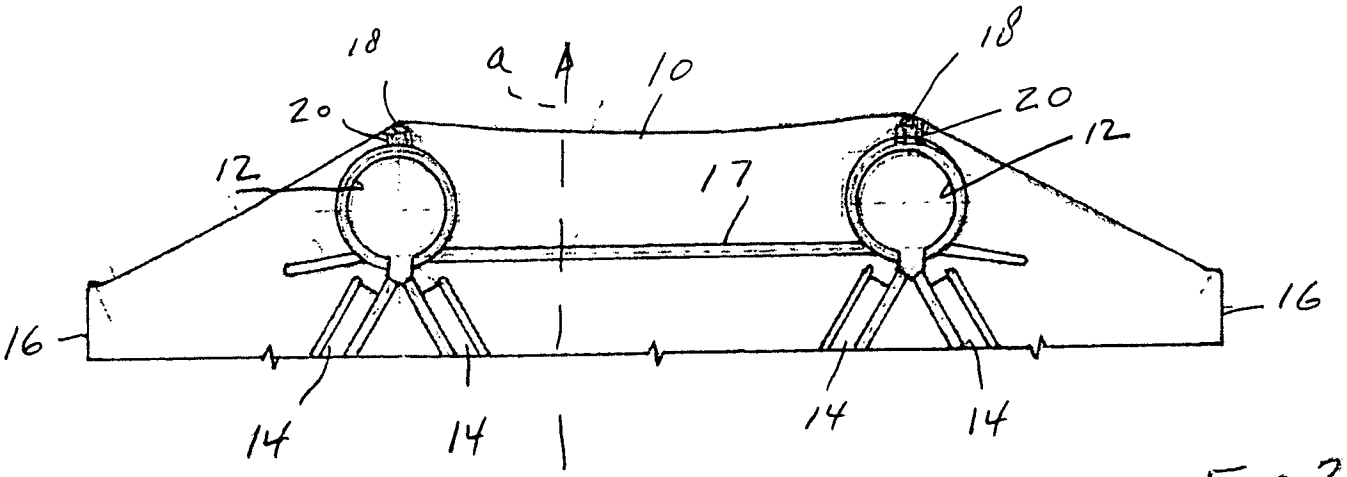
FIG. 2 is a section view taken along line 2-2 of FIG. 1, showing steam distribution ducts, and positions of wind wall and protective screen.
Figure 3:
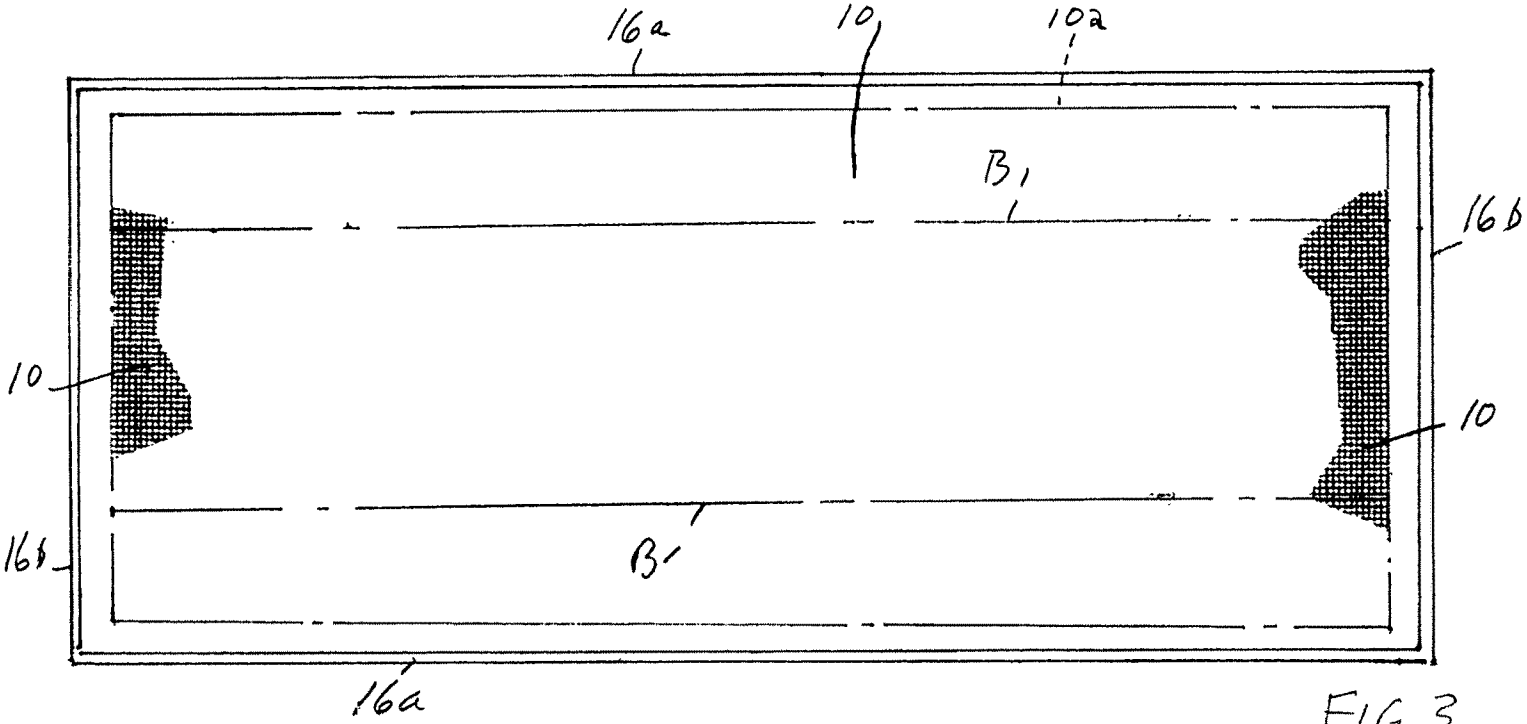
FIG. 3 is a plan view of air-cooled condenser illustrating position of protective screen over the condenser.

Referring to the drawing, FIGS. 1, 2, and 3 show arrangement of protective mesh screen 10 over air cooled condenser exhaust steam distribution ducts 12, finned condenser tubes 14, and condenser wind wall 16 to which screen is attached. Finned tubes are arranged in the form of a delta or A-frame to condense steam and drain condensate effectively. Motor-driven fans (not shown) along the A-frame base provide cooling air (arrow a) passing up through the finned Lubes to ambiance. A lateral strut 17 spaces steam ducts. The protective mesh 10 of the invention covers the air cooled condenser to prevent hail damage to tube fins as well as damage to the steam distribution ducts.

Figure 6:
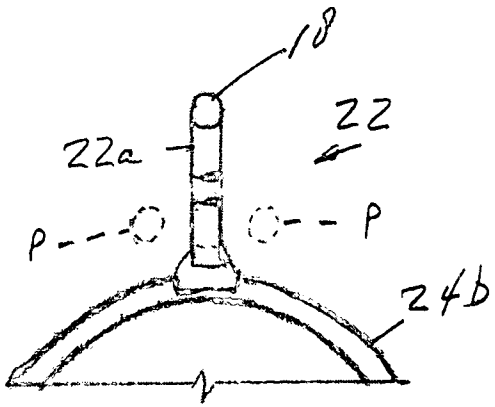
FIG. 6 is an elevation view of post for supporting the protective screen in mid-section of the condenser.
Figure 5:
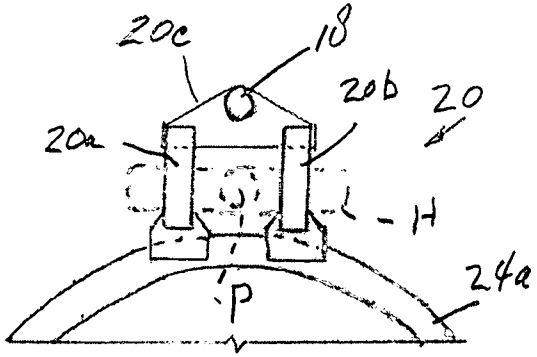
FIG. 5 is an elevation view of post for supporting the protective screen at head end of condenser.

As shown in FIGS. 1 and 3, the protective mesh screen 10 extends over substantially the entire area of air cooled condenser with screen edges 10*a* spaced from side 16*a* and end 16*b* wind wall sections. The mesh is supported above the condenser distribution ducts by longitudinal beams 18 extending along lines B. Each longitudinal beam is positioned and supported by means posts 20, 22 mounted on steam duct rings 24*a-b* located along the length of each steam duct. FIG. 5 illustrates one form of supporting post 20 carried on end ring 24*a*, and having dual posts 20*a-b* and joiner plate 20*c* for receiving a main support beam 18. Dual posts 20*a-b* are necessary to accommodate condenser air piping P and header H shown in FIG. 5. FIG. 6 illustrates a modified support post 22 for main beam 18. These modified support posts 22 are mounted on intermediate duct rings 24*b* at stations along the steam ducts. A single post 22*a* is mounted on ring 24*b* and passes between existing air pipes Pin support of main beam 18.

The hail protection mesh 10 preferably comprises steel mesh wire unrolled and draped over the top of the main beams 18 extending above the steam ducts 12. Each side 10*a* of the mesh is secured to elongate reinforcing plate 26 through which the mesh is anchored by suitable means such as turnbuckles 28 to the screen wind walls 16*a* on each side.

The protection afforded by the mesh against damaging hailstones is to reduce momentum of hailstones falling on condenser by reducing their mass and their velocity. The preferred mesh selected is 304 stainless steel wire mesh with approximately 1-inch square openings resulting in a mesh open area of approximately 78%. Stainless steel mesh is readily available, has superior corrosion resistance, and higher strength than aluminum wire mesh.

Condenser cooling air flowing through the mesh has a temperature as high as 150°. The mesh so heated reduces (melts) the amount of hail that collects on the mesh. In addition, hail that does collect on the mesh melts quickly due to good heat transfer characteristics of metallic mesh as compared to non-metallic materials.

Airflow through a typical air cooled condenser unit with fans running at full speed is approximately 11,070,000 ACFM. The protective screen installed will not decrease this flow significantly, however there is a slight increase in pressure to move the air. The protective screen has a tendency to make airflow more uniform across the unit.

Referring to FIGS. 2, 4, 5, and 6 steam duct support rings 24*a-b* provide supporting foundation for mesh 10 draped over the condenser. The supporting structure affixed to end ring shown in FIG. 5 has dual posts 20*a-b* and joiner plate for supporting each longitudinal beam 18. FIG. 6 illustrates a single post 22*a* affixed to ring 24*b* for supporting longitudinal beam 18.

Figure 4:
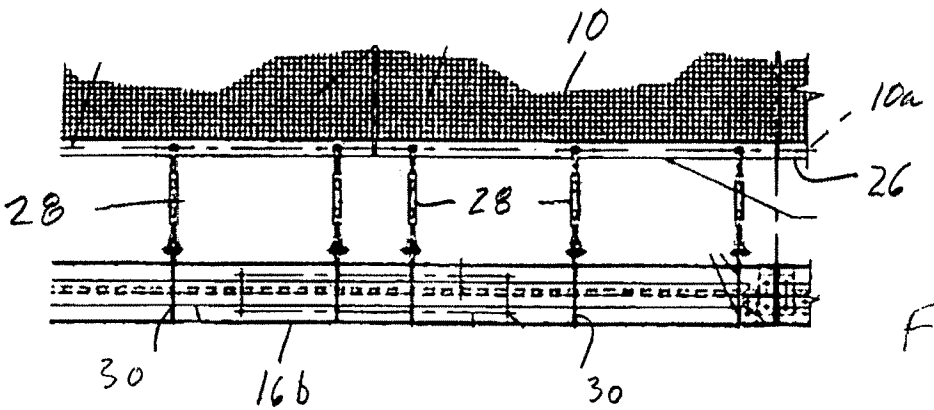
FIG. 4 is a fragmentary plan view illustrating components for securing protective screen to wind wall.

As shown in FIG. 4 a series of anchor plates 30 are affixed to the top surface 16*b* of wind wall for securing mesh 10 by means of turnbuckles 28. The anchor plates are preferably located directly over wind wall supporting columns (not shown). Turnbuckles 28 connect anchor plates 30 to mesh edge reinforcing plate 26. The tension load in the wire mesh is taken out at the outside screen walls by this anchoring which spans between screen wall support columns. The turnbuckles are used to adjust the sag in the mesh wire.

The drape of the mesh is determined by using basic catenary tension/sag equations to maintain a tension in the wire mesh that is approximately the same on each side of the steam duct support ring. The mesh is supported by structural posts 20, 22, and beams 18 above steam ducts to prevent damage caused by mesh rubbing on the duct as well as hail damage to the duct.

In a typical air cooled condenser installation, the protective screen is generally rectangular with side edges and end edges spaced from corresponding side and end walls of the condenser wind wall. Tensioning of the protective screen takes place along side walls between screen plate and wind wall anchor plates using turnbuckles.

In a further understanding of the invention, the protective screen is deployed on an air cooled condenser by a method including the following steps:

affixing support posts to stations along the length of steam distribution ducts;

aligning the support posts above the steam ducts;

mounting a longitudinal beam along the tops of the support posts of each distribution duct, selecting a protective screen capable of decaying the momentum of hail stones falling toward the condenser, and reducing the hail stones, draping the protective screen over the condenser to be supported by longitudinal beams, securing edges of the screen to condenser wind wall, and tensioning the screen to avoid rubbing against condenser components.

It is within the scope of the invention to include other embodiments of mesh, grid, and grate materials in addition to stainless steel mesh. Other materials include polyethylene mesh, wire meshes including aluminum, i.e., Al-1100 and Al 6061; galvanized steel; and fiberglass including air mesh, multigrid (small), and multigrid (large). The pros and cons of these and other materials not specifically listed including cost, material weight, strength, heat conductivity, corrosion resistance, ease of installation, ability to decay hail momentum, and ability to withstand condenser exhaust air temperatures and solar UV exposure are trade-offs which are all subject over time to relative improvement in comparison to preferred material, stainless steel mesh, and as such have potential to provide suitable hail protection systems for air cooled condensers.

The invention provides permanent protection against damage hailstorms cause to air cooled condensers especially by crushing heat transfer components, and against thermodynamic and economic degradation of the host power plant caused by such storms.

The term "approximately" for purposes of this application means plus or minus 10% of the values stated.

Various changes may be made to the structure embodying the principles of the invention. The foregoing embodiments are set forth in an illustrative and not in a limiting sense. The scope of the invention is defined by the claims appended hereto.

What is claimed is:

1. A system for protecting air cooled condenser from hail damage to elongate steam distribution ducts, duct support rings, and finned tubes components of the condenser, the condenser having a surrounding wind wall with side and end portions, the system comprising support posts mounted on the duct support rings of the condenser, the support posts extending above the ducts and extending in a line along the ducts, a longitudinal support beam carried by the support posts in said line above each of the ducts, a protective mesh screen draped over and supported by a support beam over each of the ducts in covering relation to condenser distribution ducts and finned tube components, screen anchors secured to the wind wall side portions, means interconnecting protective mesh screen and screen anchors for tensioning the screen across the support beams and above condenser components so that hailstones falling toward the condenser have momentum decayed by the protective screen.

2. A system as defined in claim 1 in which the protective screen is stainless steel.

3. A system as defined in claim 2 in which the protective screen is 304 stainless steel with one inch square openings, and an open area of approximately 78%.

4. A system as defined in claim 1 in which the protective screen is selected from a group consisting of stainless steel mesh, polyethylene mesh, aluminum 1100 mesh, aluminum 6061 mesh; galvanized steel mesh; and fiberglass consisting of air mesh, multigrid small, and multigrid large.

5. A method of protecting an air cooled condenser from hailstone damage the condenser having steam distribution ducts comprising the steps of:

affixing support posts to stations along the length of steam distribution ducts;

aligning the support posts above the steam ducts;

mounting a longitudinal beam along the tops of the aligned support posts of each distribution duct, selecting a protective screen capable of decaying the momentum of hail stones falling toward the condenser, and reducing the hail stones, the screen having side edges, draping the protective screen over the condenser to be supported by the longitudinal beams, securing side edges of the screen to condenser wind wall, and tensioning the screen to avoid rubbing against condenser components.

* * * * *